US006146580A

United States Patent [19]

Bontaites, Jr.

[11] Patent Number: 6,146,580

[45] Date of Patent: Nov. 14, 2000

[54] METHOD AND APPARATUS FOR MANUFACTURING NON-WOVEN ARTICLES

[75] Inventor: George J. Bontaites, Jr., Marblehead, Mass.

[73] Assignee: Eldim, Inc., Peabody, Mass.

[21] Appl. No.: 09/193,582

[22] Filed: Nov. 17, 1998

[51] Int. Cl.[7] ..... D01D 5/08; D02G 3/00; D04H 3/00

[52] U.S. Cl. ..... 264/555; 264/103; 264/148; 264/211.12; 264/571

[58] Field of Search ..... 264/103, 148, 264/211.12, 518, 555, 571

[56] References Cited

U.S. PATENT DOCUMENTS

| | | | |
|---|---|---|---|
| 3,590,453 | 7/1971 | Bryand | 29/121 |
| 3,878,014 | 4/1975 | Melead | 156/167 |
| 4,011,124 | 3/1977 | Baxter | 156/358 |
| 4,177,312 | 12/1979 | Rasen et al. | 428/284 |
| 4,187,131 | 2/1980 | Shortway et al. . | |
| 4,205,123 | 5/1980 | Palmer et al. | 429/147 |
| 4,223,059 | 9/1980 | Schwarz . | |
| 4,380,570 | 4/1983 | Schwarz . | |
| 4,388,056 | 6/1983 | Lee et al. | 425/83.1 |
| 4,639,254 | 1/1987 | LeGault et al. . | |
| 4,761,258 | 8/1988 | Enloe | 264/518 |
| 4,847,125 | 7/1989 | Schwarz . | |
| 4,904,514 | 2/1990 | Morrison et al. . | |
| 4,936,934 | 6/1990 | Buehning . | |
| 5,036,551 | 8/1991 | Dailey et al. . | |
| 5,437,107 | 8/1995 | Ensign et al. . | |
| 5,476,616 | 12/1995 | Schwarz . | |
| 5,565,259 | 10/1996 | Juriga . | |
| 5,582,905 | 12/1996 | Beck et al. . | |
| 5,656,232 | 8/1997 | Takai et al. | 264/518 |
| 5,699,791 | 12/1997 | Sukiennik et al. . | |
| 5,749,729 | 5/1998 | Skinner et al. . | |
| 5,766,400 | 6/1998 | Gallagher, Jr. . | |
| 5,853,628 | 12/1998 | Varona . | |

FOREIGN PATENT DOCUMENTS

| | | |
|---|---|---|
| 226 939 | 7/1987 | European Pat. Off. . |
| 428 400 A1 | 5/1991 | European Pat. Off. . |
| 460 310 A1 | 12/1991 | European Pat. Off. . |
| 841 424 A1 | 5/1998 | European Pat. Off. . |

OTHER PUBLICATIONS

Notification of Transmittal of the International Search Report dated May, 2000.

*Primary Examiner*—Leo B. Tentoni
*Attorney, Agent, or Firm*—Testa Hurwitz & Thibeault, LLP

[57] ABSTRACT

A method of manufacturing a non-woven material using a contoured honeycomb drum with an outer microporous surface, more particularly with a contoured outer surface, for the manufacture of contoured non-woven fibrous materials. The method can use spunbond or melt blown techniques for depositing solidifying filaments on the microporous surface such that the non-woven material conforms to the contour of the drum, and then removing the non-woven material from the drum. The drum of the current invention facilitates continuous production of non-woven articles with three dimensional shapes such as surgical masks or pleated air filters.

6 Claims, 9 Drawing Sheets

METHOD AND APPARATUS FOR MANUFACTURING NON-WOVEN ARTICLES

Field of the Invention

This invention relates to a method of using a honeycomb drum with an outer microporous surface, more particularly with a contoured outer surface, for the manufacture of contoured non-woven fibrous materials.

BACKGROUND OF THE INVENTION

Non-woven articles are used in applications that require materials to be air permeable. Some applications of non-woven materials are surgical masks and filter membranes. Since many applications that use non-woven material are disposable, the non-woven materials should be easily manufacturable and low cost. Some methods of manufacturing non-woven materials are spunbonded and melt blown processes.

FIG. 1 illustrates the spunbonded process 10 for manufacturing non-woven materials. Thermoplastic fiber forming polymer 12 is placed in an extruder 14 and passed through a linear or circular spinneret 16. The extruded polymer streams 18 are rapidly cooled and attenuated by air and/or mechanical drafting rollers 20 to form desired diameter solidifying filaments 22. The solidifying filaments 22 are then laid down on a first conveyor belt 24 to form a web 26. The web 26 is then bonded by rollers 28 to form a spunbonded web 30. The spunbonded web 30 is then transferred by a second conveyer belt 32 and then to a windup 34. Spunbonding is an integrated one step process which begins with a polymer resin and ends with a finished fabric.

FIG. 2 illustrates the melt blown process 40 for manufacturing non-woven materials. Thermoplastic forming polymer 42 is placed in an extruder 44 and is then passed through a linear die 46 containing about twenty to forty small orifices 48 per inch of die 46 width. Convergent streams of hot air 50 rapidly attenuate the extruded polymer steams 52 to form solidifying filaments 54. The solidifying filaments 54 subsequently get blown by high velocity air 56 onto a take-up screen 58 thus forming a melt blown web 60. The web is then transferred to a windup 62. U.S. Pat. No. 4,380,570 entitled"Apparatus and Process for Melt-Blowing a Fiberforming Thermoplastic Polymer and Product Produced Thereby," describes the melt-blown process and is incorporated herein by reference in its entirety.

While non-woven materials can be manufactured by either the spunbonded or melt blown process there are difficulties associated with each process. For example, the newly manufactured non-woven material (e.g. melt blown web 60) tends to stick to the take-up screen 58. Further, the processes produce sheet material. Accordingly, to manufacture non-woven materials into three dimensional shapes, e.g. surgical masks and pleated filters, some form of post-processing is required.

SUMMARY OF THE INVENTION

The present invention relates to a method for manufacturing non-woven articles. In one embodiment the method comprises providing a drum made of a tubular honeycomb member that forms an outer contour and is surrounded by a microporous layer, depositing solidifying filaments on the microporous layer to form a non-woven material that matches the contour of the drum, and removing the non-woven material from the drum.

In another embodiment of the present invention, the method for manufacturing non-woven articles further adds the step of providing a negative pressure to a part of the drum to conform the solidifying filaments to the contour of the drum.

In another embodiment of the present invention, the method of manufacturing a non-woven article also includes the additional step of providing a positive pressure to a portion of the drum to facilitate removing the non-woven material from the drum.

In another embodiment of the present invention, the method of manufacturing a non-woven article also includes the additional step of treating the non-woven material with additional supplements such a stain repellent or coloring.

Another embodiment of the present invention relates to a drum, with a generally tubular honeycomb member that has an outer surface forming a contour, and the contour is covered with a microporous layer, for the manufacture of a non-woven materials.

In another embodiment of the present invention the drum can have a negative pressure applied to a portion of the drum in order to help the non-woven materials conform to the contoured outer surface of the drum.

In another embodiment of the present invention the drum can have a positive pressure applied to a portion of the drum in order to help remove the non-woven materials from the drum.

In another embodiment of the present invention the drum can be made up of panels with different contoured outer surfaces to generate non-woven materials of different shapes from the same drum.

BRIEF DESCRIPTION OF THE DRAWINGS

This invention is pointed out with particularity in the appended claims. The above and further advantages of this invention may be better understood by referring to the following description, taken in conjunction with the accompanying drawings, in which:

DETAILED DESCRIPTION OF THE INVENTION

Figure 1:
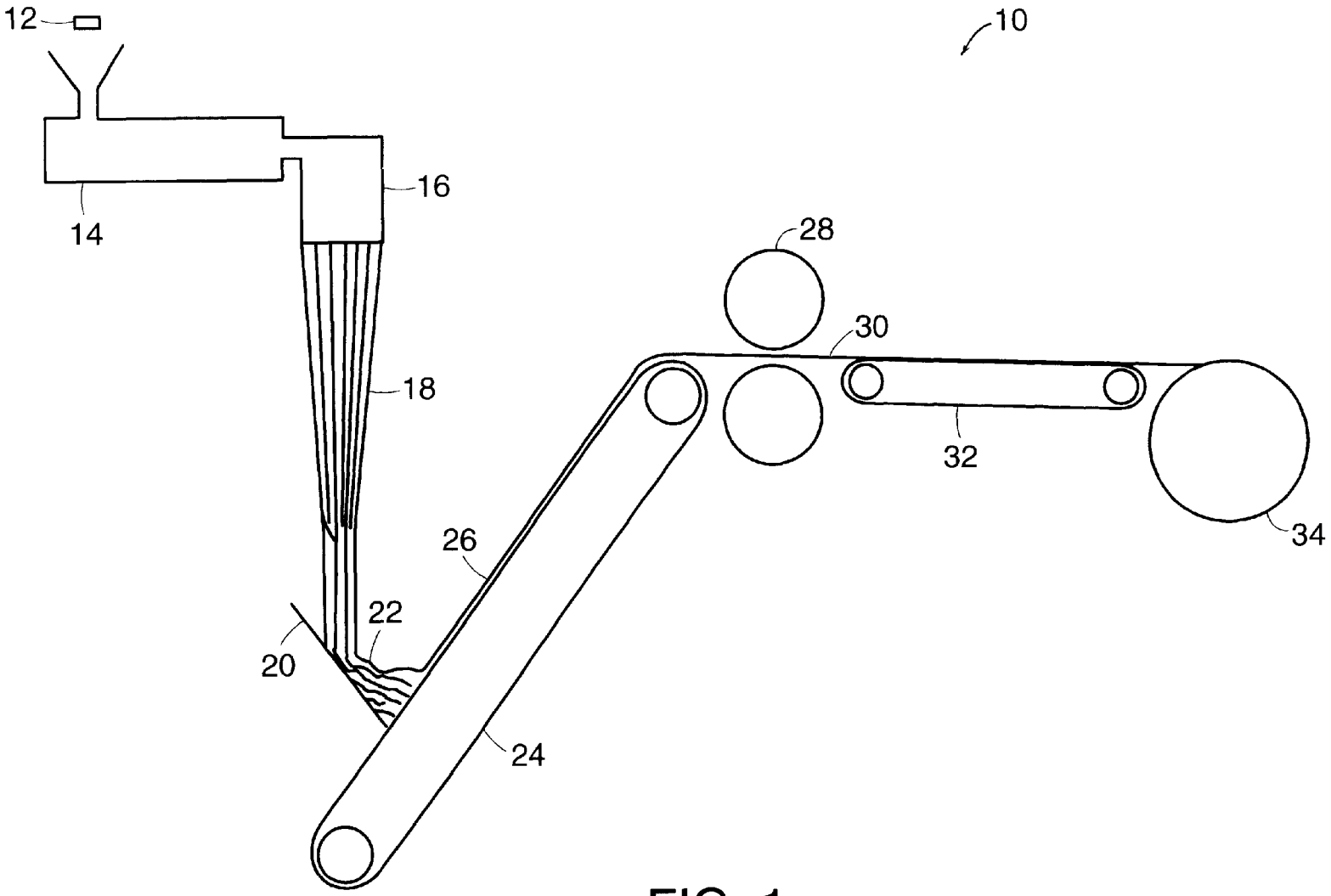
FIG. 1 PRIOR ART
FIG. 1 is a schematic of the prior art spunbound process for manufacturing non-woven materials.
Figure 2:
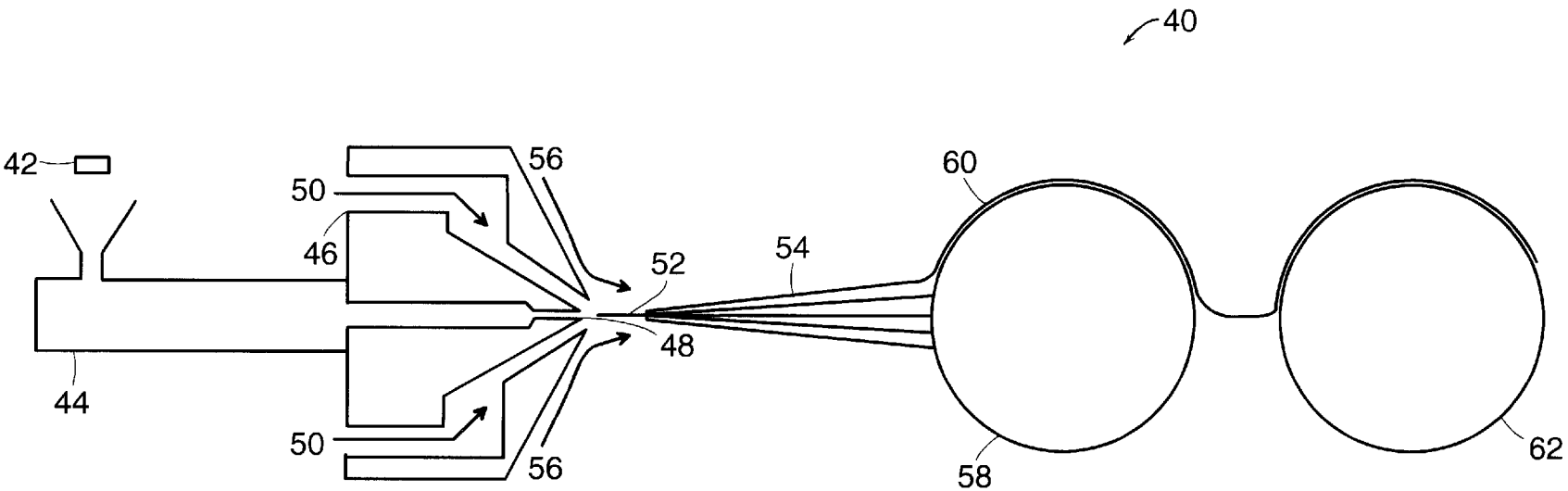
FIG. 2 PRIOR ART
FIG. 2 is a schematic of the prior art melt blown process for manufacturing non-woven materials.
Figure 3A:
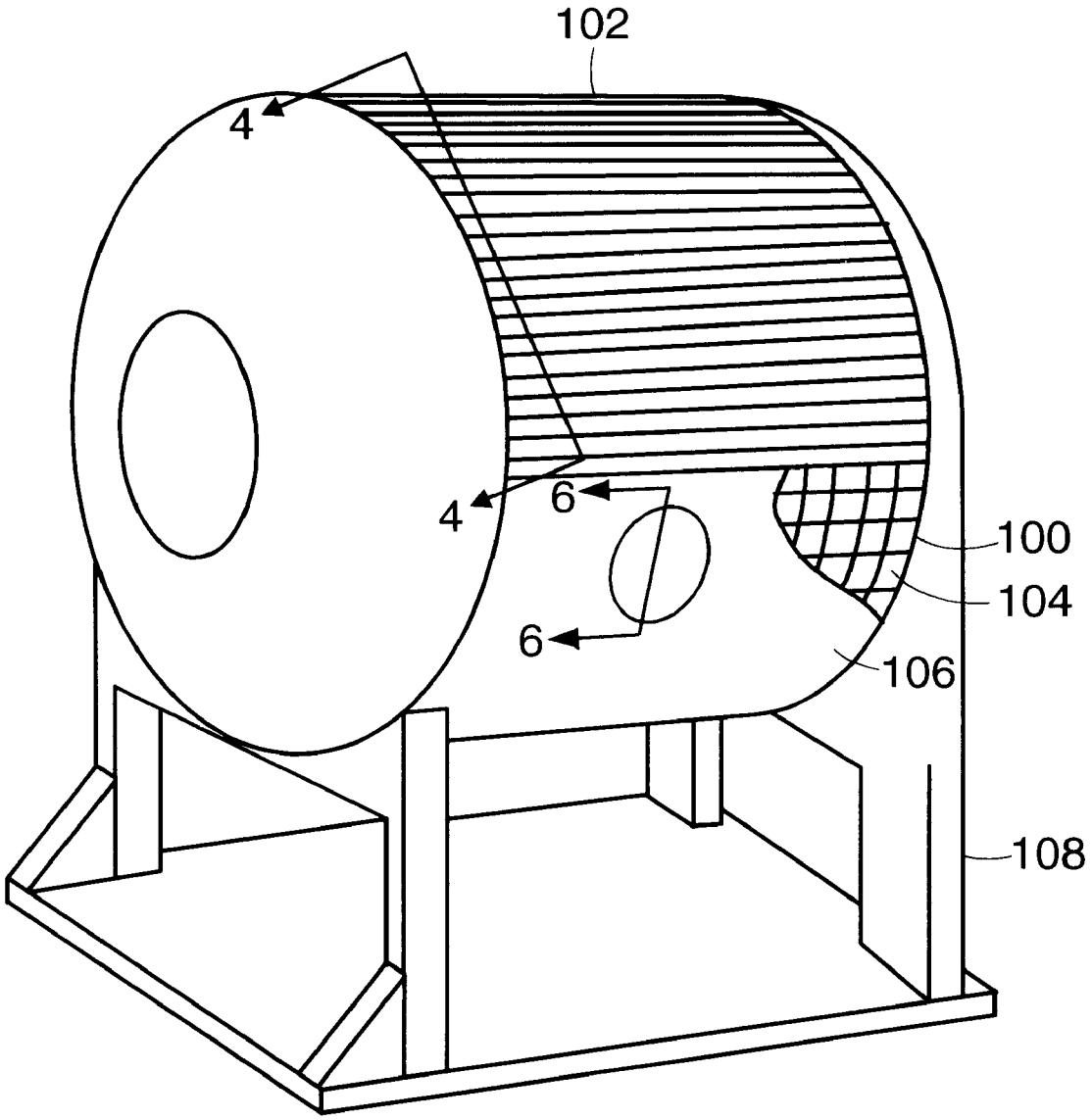
FIG. 3A is a perspective view of an embodiment of the drum of the current invention, illustrating a contoured honeycomb tube with an outer microporous surface.

Referring to FIG. 3A, shown is a drum 100 having a contoured outer surface 102 constructed in accordance with the teachings of the present invention. The contoured outer surface 102 may take many different shapes and forms. As shown, the drum 100 is made of a tubular honeycomb member 104 that is surrounded by a microporous layer 106. The microporous layer 106 is tack welded to the tubular honeycomb member 104 and may be finely electroetched stainless steel having numerous holes on the order of 0.010 inches in diameter such that the microporous layer 106 is about fifty percent open. The drum 100 is supported by a frame 108 rotatably supporting the drum 100. The material for the tubular honeycomb member 104 can be, but is not limited to, stainless steel.

Figure 3B:
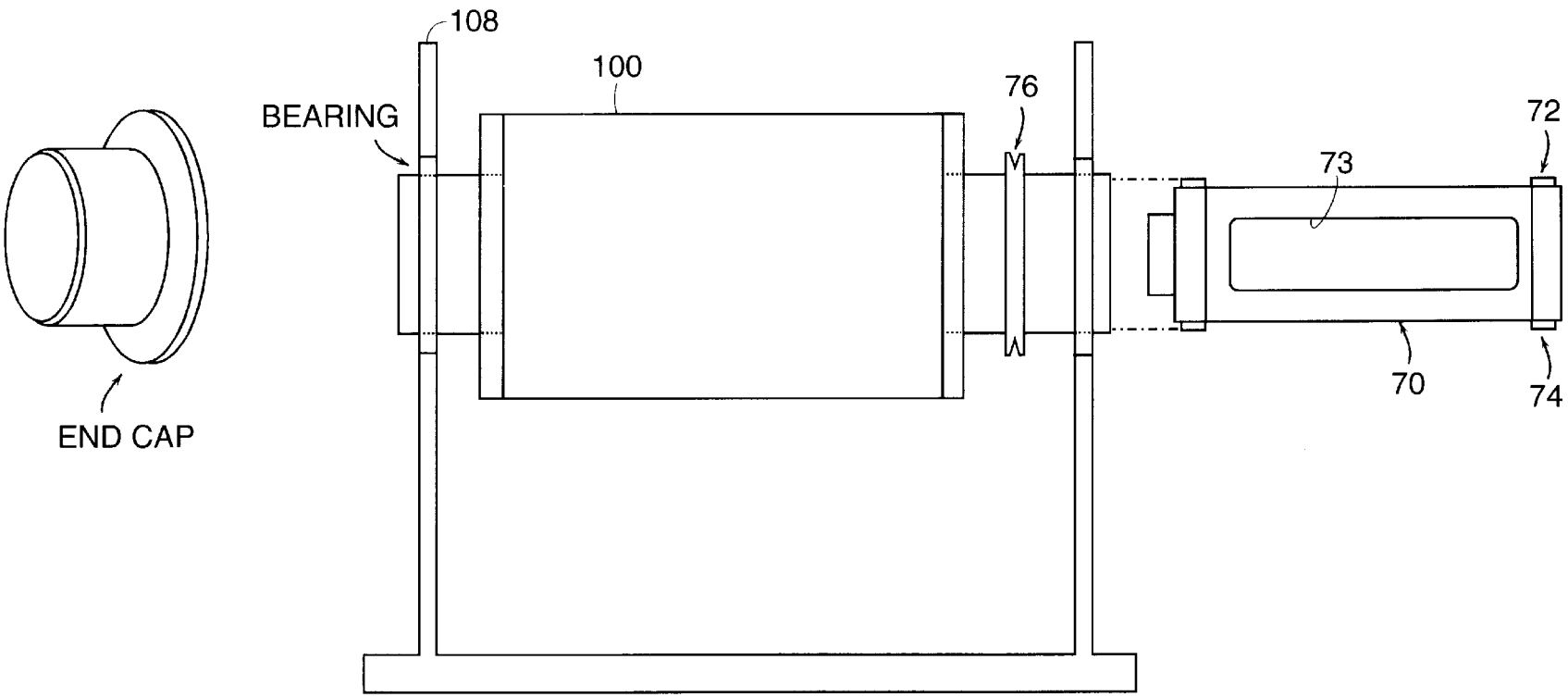
FIG. 3B is a side view of drum illustrating the mounting structure, vacuum apparatus, and V-belt drive groove.

Referring to FIG. 3B, the drum 100 is supported by a frame 108 or frame so that the drum can be rotated as the solidifying filaments can be continuously applied. FIG. 3B also shows a pipe 70 with a vacuum port 72 and a bearing surface 74. The pipe 70 is located in the center of the drum 100. The pipe 70 also has a slot 73 that is in communication with a vacuum port 72 to draw a negative pressure 75 through a sector of the drum 100 to conform the solidifying filaments to the contour. Also shown is V-belt drive 76 which can be used to rotate the drum 100 by any conventional source known to those skilled in the art, such as a variable speed motor.

Figure 3C:
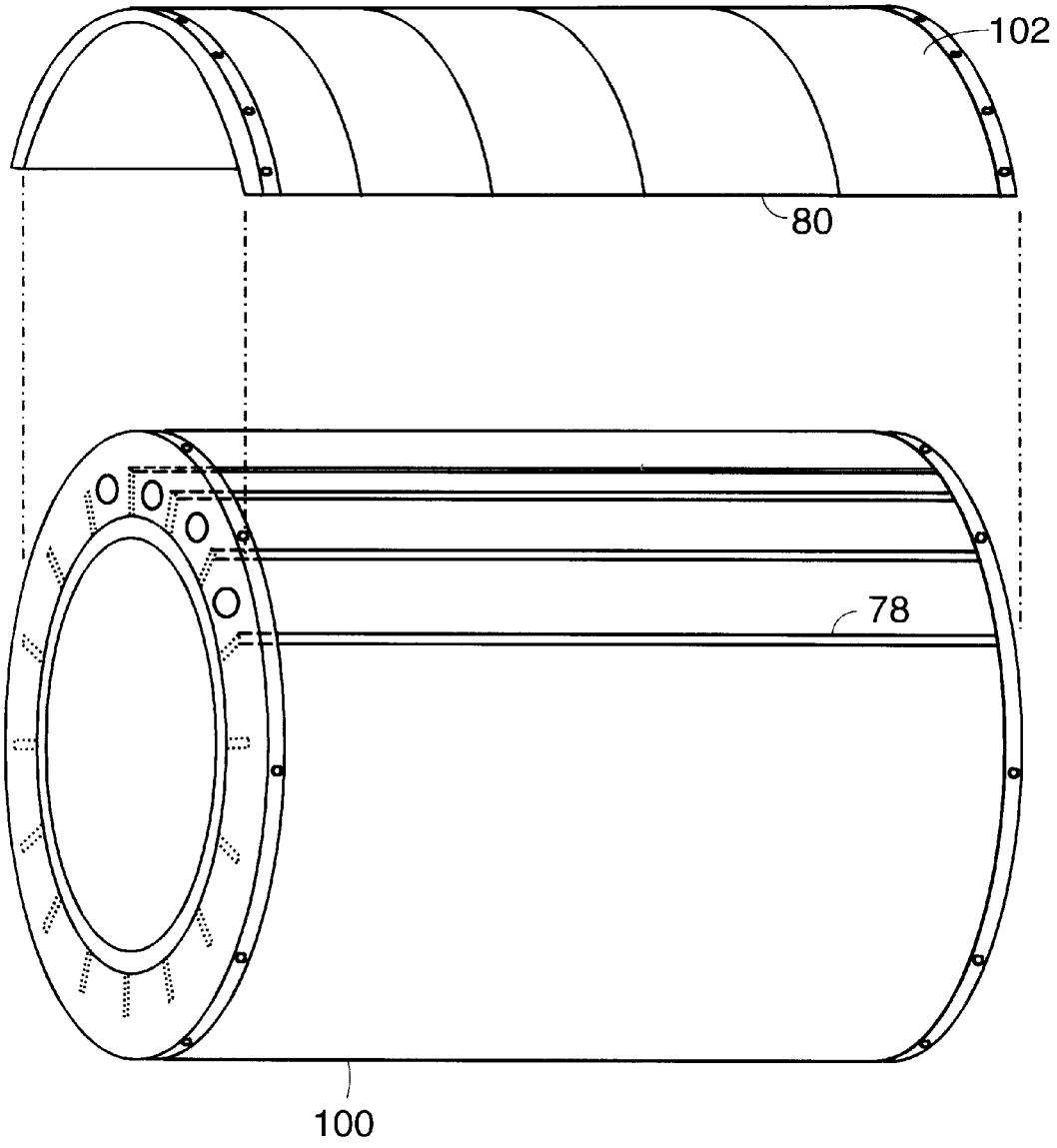
FIG. 3C is a perspective view of the drum structure.

Referring to FIG. 3C, the drum 100 includes inner support bars 78 which are located throughout the drum 100. The inner support bars 78 provide stiffness to the drum 100 and allow a negative pressure 75 or positive pressure 77 to be provided to a portion of the drum 100. FIG. 3C also shows that the drum 100 includes a plurality of panels 80 that can attached to the drum 100 by a variety of means (e.g. fasteners, or clips). The panels 80 can be made to form any desired contoured outer surface 102.

Figure 4:
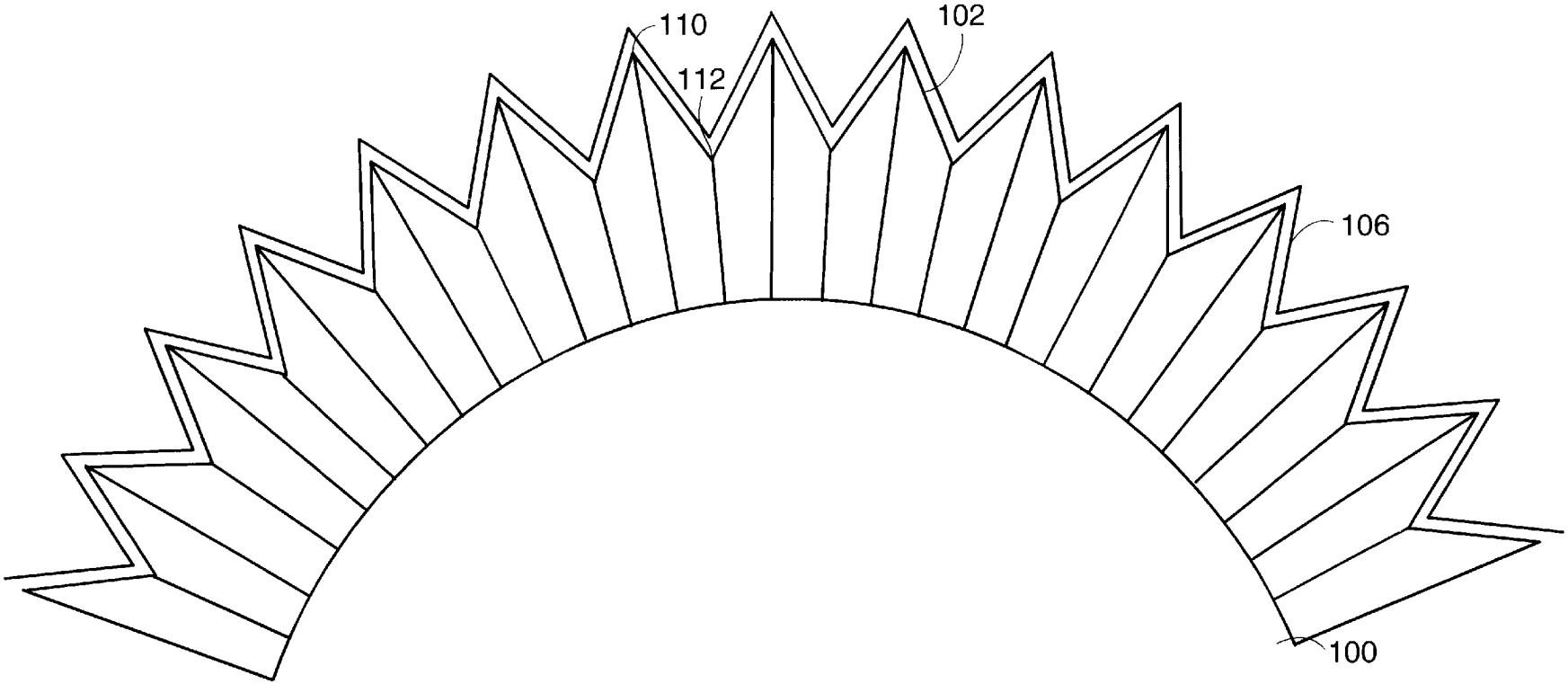
FIG. 4 is a cross-sectional view of the drum illustrating a pleated surface.

Referring to FIG. 4, shown is a partial cross-sectional view of one embodiment of the drum 100 of the present invention. The drum 100 has an contoured outer surface 102 that has the shape of alternating peaks 110 and valleys 112. The contoured outer surface 102 is covered by the microporous layer 106. As will be further shown, the contoured outer surface 102 with alternating peaks 110 and valleys 112 can be used to form pleated-shaped non-woven articles.

Figure 5:
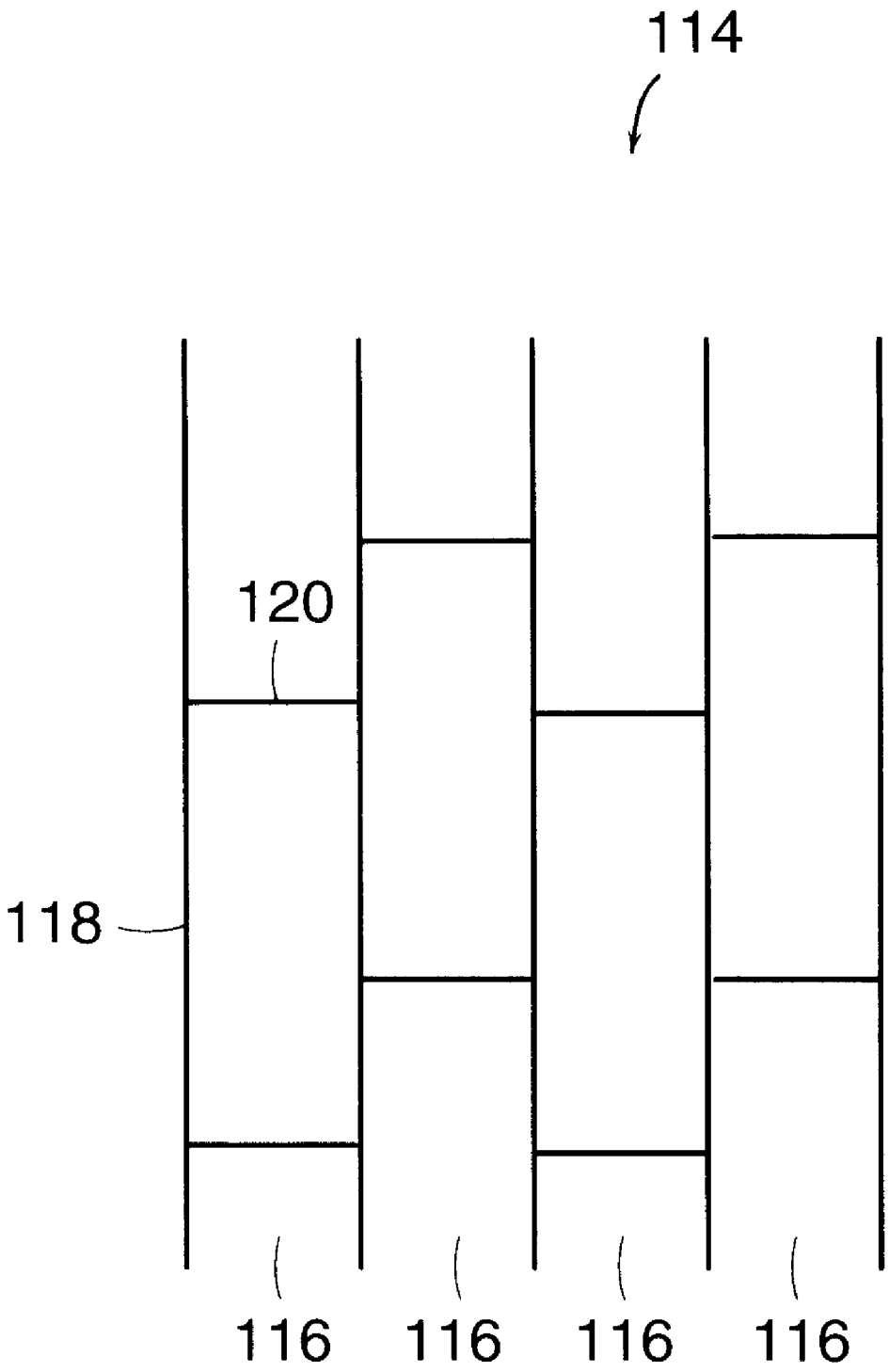
FIG. 5 is a cross-sectional view of the drum illustrating the honeycomb mesh.

Referring to FIG. 5, shown is a cross-sectional view of the drum 100 illustrating the rectangular mesh 1 14 of tubular honeycomb member 104. The mesh 1 14 consists of alternating multiple rows of mesh holes 116, where each row is offset from the previous row. Each mesh hole has a length 118 and width 120. In one embodiment the mesh hole length 118 is about 0.5 inches and the width 120 is about 0.25 inches. By using a rectangular mesh 114 the honeycomb member 104 can be readily formed into a circular contour.

Figure 6:
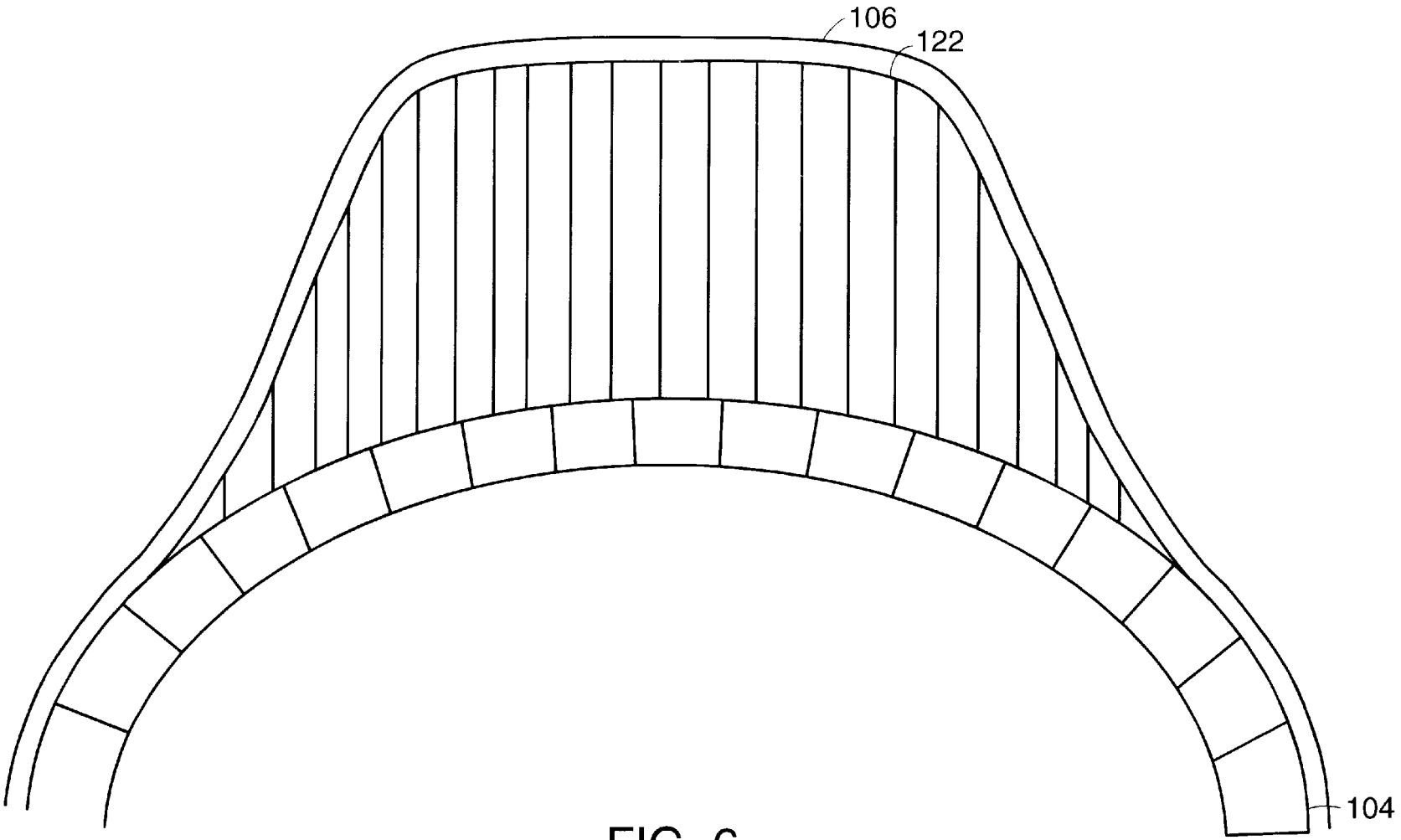
FIG. 6 is a cross-sectional view of the drum illustrating a contoured outer surface having a three dimensional surface.

Referring to FIG. 6, shown is another cross-sectional view of the drum 100 illustrating a three dimensional form 122 that is attached (e.g. tack-welded) to the drum 100. The three dimensional form 122 also has honeycomb construction and can be formed by, but not limited to, electrical discharge machining. The three dimensional form 122 is also covered by the microporous layer 106. As will be further shown, the three dimensional form 122 can be used to make, for example, a surgical mask shaped article.

Figure 7:
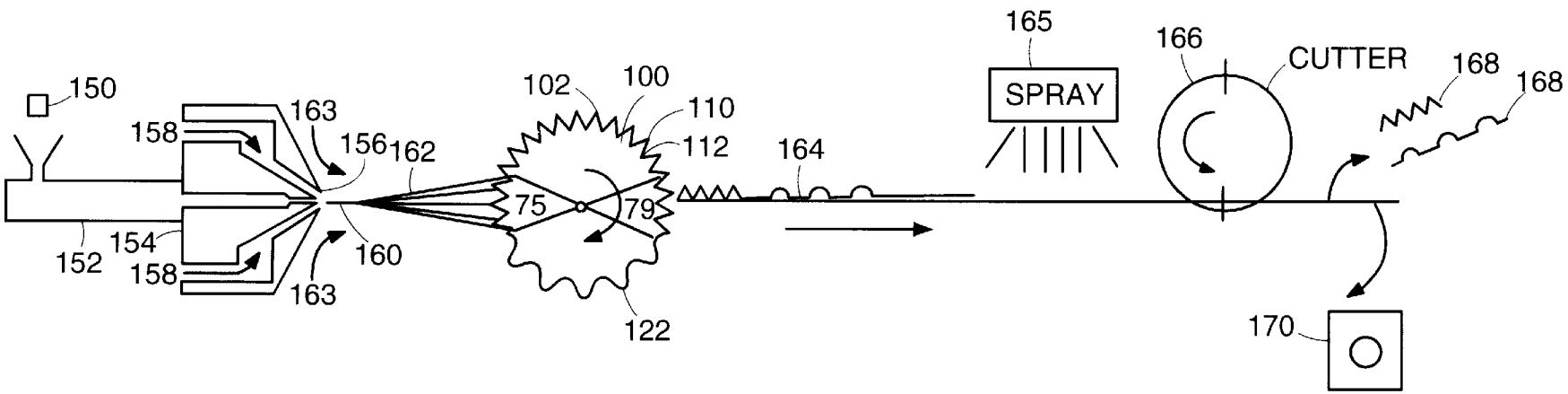
FIG. 7 is a schematic of the process of the current invention for the manufacture of non-woven materials that substantially match the contoured outer surface of the drum.

FIG. 7, shows one process for manufacturing contoured non-woven articles. Thermoplastic forming polymer 150 is placed in an extruder 152 and passed through a linear die 154 containing about twenty to forty or more small orifices 156 per inch of die 154 width. Convergent streams of hot air 158 rapidly attenuate the extruded polymer 160 to form solidifying filaments 162. The solidifying filaments 162 subsequently get blown by high velocity air 163 onto the contoured outer surface 102 of drum 100. Note that the method illustrated in FIG. 7 for generating the solidifying filaments 162 is a melt blown process, but a spunbound process, or any other method for generating the solidifying filaments 162 can be used. Melt blown process equipment is available from Biax Fiberfilm Corporation located in Neenah, Wis. 54957.

The drum 100, which is rotating, has an contoured outer surface 102 which can have a combination of shapes, for example, alternating peaks 110 and valleys 112 or a series of three dimensional forms 122. Once the solidifying filaments 162 are deposited on the drum 100, a vacuum or negative pressure 75 can be applied to a portion of the drum 100 to conform the solidifying filaments 162 to the contoured outer surface 102, to prepare closely matching contoured non-woven materials 164.

After the contoured non-woven materials 164 are formed, the rotating drum 100 rotates to a point where the contoured non-woven materials 164 are removed from the drum 100. Positive pressure 79 can optionally be applied through a portion of the drum 100 to facilitate removing the contoured non-woven materials 164 from the drum 100. Once off the drum 100 the contoured non-woven material 164 can be post processed in a variety of post processing operations, for examples by application of a spray 165. The treatment can consist of adding various supplements such as flame retardents, stain repellents, colored dyes, and the like, or to change the shape, feel, texture, or appearance of the material 164.

After any post processing has been completed, the contoured non-woven material 164 may pass through a cutter 166, to cut the contoured non-woven material 164 into the desired article or final product 168. The cutter 166 may be a die, water jet, laser, or any other apparatus capable of trimming to the desired contour. Any waste 170 after the cutting operation can either be disposed of or recycled. Accordingly, non-woven contoured articles such as wipes, filters, face masks, sorbent products, insulation, clothing and the like can be rapidly produced from polypropylene, polyester, or other materials in a continuous process at low cost.

Variations, modifications, and other implementations of what is described herein will occur to those of ordinary skill in the art without departing from the spirit and the scope of the invention as claimed. Accordingly, the invention is to be defined not by the preceding illustrative description, but instead by the following claims. What is claimed is:

What is claimed is:

1. A method of forming a non-woven article comprising the steps of:

providing a drum comprising:

a generally tubular honeycomb member having an outer surface forming a contour;

depositing solidifying filaments on the contour to form a non-woven fibrous material substantially matching at least a portion of the contour; and removing the fibrous material from the drum.

2. The method of claim 1 further comprising the step of providing negative pressure to at least a portion of the honeycomb member to conform the solidifying filaments to the contour.

3. The method of claim 1 further comprising the step of providing positive pressure to at least a portion of the honeycomb member to facilitate removing the fibrous material from the drum.

4. The method of claim 1 further comprising the step of post processing the non-woven material.

5. The method of claim 1 further comprising the step of trimming the article from the non-woven material.

6. The method of claim 1 wherein the drum further comprises a microporous layer covering at least a portion of the contour.

* * * * *